US008134757B2

(12) United States Patent
Torimaru et al.

(10) Patent No.: US 8,134,757 B2
(45) Date of Patent: Mar. 13, 2012

(54) IMAGE FORMING APPARATUS

(75) Inventors: Satoru Torimaru, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 856 days.

(21) Appl. No.: 12/196,612

(22) Filed: Aug. 22, 2008

(65) Prior Publication Data

US 2009/0231642 A1 Sep. 17, 2009

(30) Foreign Application Priority Data

Mar. 14, 2008 (JP) ..... 2008-066491

(51) Int. Cl.
*H04N 1/04* (2006.01)

(52) U.S. Cl. ..... 358/474; 358/497; 358/498; 358/488; 271/3.14; 271/3.01; 399/367; 399/388

(58) Field of Classification Search ..... 358/496, 358/497, 474, 498, 486, 488, 296; 271/3.14, 271/3.01, 3.13; 399/388, 401, 316, 107, 399/377, 3, 379, 364, 367, 85
See application file for complete search history.

(56) References Cited

U.S. PATENT DOCUMENTS 5,461,488 A * 10/1995 Witek ..... 358/402
5,596,399 A * 1/1997 Dempsey et al. ..... 399/45
5,669,056 A * 9/1997 Rubscha ..... 399/367
5,848,320 A * 12/1998 Yaginuma et al. ..... 399/45
5,881,351 A * 3/1999 Shimotoso et al. ..... 399/377
5,946,527 A * 8/1999 Salgado et al. ..... 399/82
2003/0049060 A1 3/2003 Suzuki ..... 399/361
2005/0100358 A1* 5/2005 Ushio et al. ..... 399/82
2005/0238397 A1 10/2005 Kitaoka et al. ..... 399/367
2006/0288331 A1 12/2006 Asakawa
2007/0020007 A1* 1/2007 Azuma ..... 399/367

FOREIGN PATENT DOCUMENTS

JP 2001-235918 8/2001
JP 2005-354454 12/2005
JP 2006-343393 12/2006

* cited by examiner

*Primary Examiner* — Negussie Worku
(74) *Attorney, Agent, or Firm* — Morgan, Lewis & Bockius LLP

(57) ABSTRACT

An image forming apparatus includes: a document loading tray that loads a document; a document transport path that transports the document; an image reading unit that is disposed in the document transport path and reads an image of the document; a document output tray into which the document that has been transported on the document transport path is ejected; a recording medium loading tray into which a recording medium is loaded; a recording medium transport path on which the recording medium is transported; an image recording unit that is disposed in the recording medium transport path and records an image on the recording medium; and a recording medium output tray into which the recording medium that has been transported on the recording medium transport path is output. The recording medium loading tray is disposed between the document loading tray and the document output tray.

16 Claims, 9 Drawing Sheets

IMAGE FORMING APPARATUS

CROSS-REFERENCE TO RELATED APPLICATION

This application is based on and claims priority under 35 USC 119 from Japanese Patent Application No. 2008-066491 filed on Mar. 14, 2008.

BACKGROUND

Technical Field

The present invention relates to an image forming apparatus.

SUMMARY OF THE INVENTION

A first aspect of the present invention is an image forming apparatus including: a document loading tray that loads a document; a document transport path that transports the document; an image reading unit that is disposed in the document transport path and reads an image of the document; a document output tray into which the document that has been transported on the document transport path is ejected; a recording medium loading tray into which a recording medium is loaded; a recording medium transport path on which the recording medium is transported; an image recording unit that is disposed in the recording medium transport path and records an image on the recording medium on the basis of image signals of the image that the image reading unit has read or input signals from the outside; and a recording medium output tray into which the recording medium that has been transported on the recording medium transport path is output, the recording medium loading tray being disposed between the document loading tray and the document output tray.

BRIEF DESCRIPTION OF THE DRAWINGS

An exemplary embodiment of the present invention will be described in detail based on the following figures, wherein.

DETAILED DESCRIPTION

Below, an example of an exemplary embodiment pertaining to the present invention will be described on the basis of the drawings.

(Configuration of Image Forming Apparatus Pertaining to Present Exemplary Embodiment)

Figure 1:
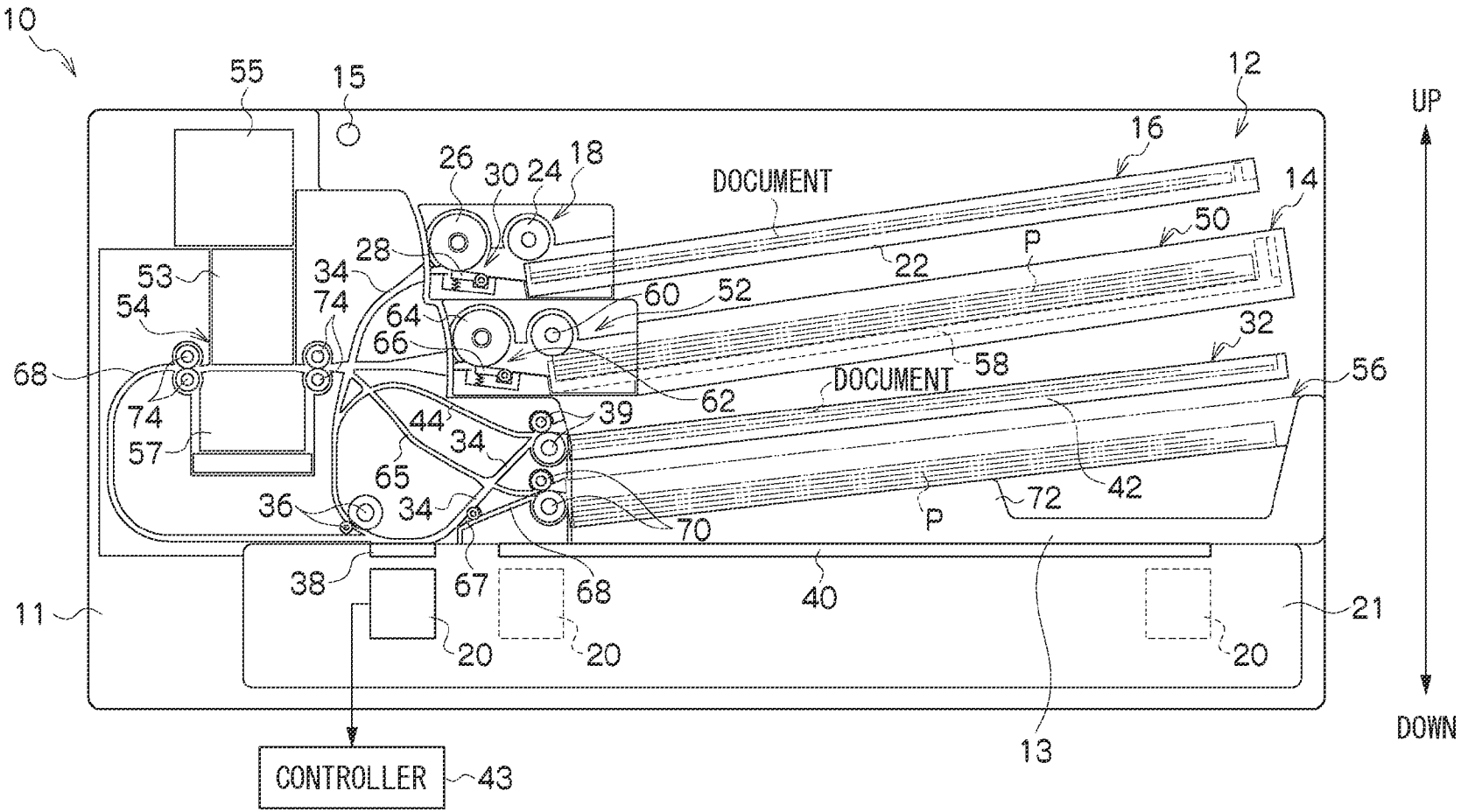
FIG. 1 is a general diagram showing the overall configuration of an image forming apparatus pertaining to the exemplary embodiment of the present invention.

The configuration of an image forming apparatus 10 pertaining to the present exemplary embodiment will be described. FIG. 1 is a general diagram showing the configuration of the image forming apparatus 10 pertaining to the present exemplary embodiment. It will be noted that FIG. 1 and drawings indicated below show a vertical direction of the apparatus by arrows in the drawings.

The image forming apparatus 10 pertaining to the present exemplary embodiment is disposed with an apparatus body 11 and a platen cover 13 that serves as an example of an open/close component that is disposed in the upper portion of the apparatus body 11 and is capable of being opened and closed with respect to the apparatus body 11.

Further, the image forming apparatus 10 pertaining to the present exemplary embodiment is disposed with an image reading mechanism 12 that reads an image of a document and an image recording mechanism 14 that records an image on a recording medium P such as paper.

First, the image reading mechanism 12 will be described.

The image reading mechanism 12 is disposed with a document housing component (document loading tray) 16 in which a document is housed, a document conveying component 18 that conveys the document that is housed in the document housing component 16, an image reading unit 20 that is capable of moving with respect to a document that has been placed in a fixed position and reading an image of that document and, with respect to a document that is conveyed by the document conveying component 18, is capable of reading image of that document in a predetermined position, and a document output tray 32 into which a document that has been conveyed by the document conveying component 18 is ejected.

The document housing component 16 is disposed with a holder 22 for placing a document. A document is placed in this holder 22 with its reading surface, which becomes a reading target, face up, and the document is housed in the document housing component 16.

The document conveying component 18 is disposed with a feeding roll 24 that feeds the document that is housed in the document housing component 16 from the document housing component 16. A separating mechanism 30 that separates, one sheet at a time, the document that has been fed from the document housing component 16 is disposed on the downstream side of the feeding roll 24. The separating mechanism 30 is disposed with a conveying roll 26, which imparts conveyance force to the document that has been fed by the feeding roll 24 from the front side of the document, and a separating pad 28, which imparts conveyance resistance to the document that has been fed by the feeding roll 24 from the back side of the document.

Thus, when plural documents are superimposed and fed from the document housing component 16, the conveying roll 26 imparts conveyance force to the upper document (the first document), and conveyance resistance is imparted by the separating pad 28 to the lower documents (the second document on), whereby the documents are separated. In this manner, the superimposed documents are sorted and fed one sheet at a time by the feeding roll 24 and the separating pad 28.

A U-shaped conveyance path 34 for conveying the document that has been separated by the separating mechanism 30 to the document output tray 32 is formed in the document conveying component 18. Conveying rolls 36 that convey the document and ejecting rolls 39 that eject the document to the document output tray 32 are disposed in this conveyance path 34.

The document output tray 32 is disposed with a holder 42 in which the document that has been ejected by the ejecting rolls 39 is placed, and the document that has been ejected by the ejecting rolls 39 is placed in the holder 42 with its reading surface face down and housed in the document output tray 32.

Further, the image forming apparatus 10 may also be configured such that the document housing component (document loading tray) 16, a recording medium housing component (recording medium loading tray) 50, the document output tray 32 and a recording medium output tray 56 are disposed in a tier-like manner in order to make it easy to handle housing of documents, replenishment of recording media, documents after ejection and recording media after ejection. The document output tray 32 is offset in the width direction of the document (direction orthogonal to the conveyance direction) with respect to the document housing component 16, and the document output tray 32 and the document housing component 16 are disposed in a tier-like manner. It will be noted that when the image forming apparatus 10 is configured such that a person who handles the document from one side in the width direction of the document faces the apparatus (e.g., when an operating component for performing reading and the like is disposed on one side in the width direction of the document), the document output tray 32 is offset with respect to the document housing component 16 on that side.

Further, the document output tray 32 may also be configured to be offset along the conveyance direction with respect to the document housing component 16 and is disposed in a tier-like manner. In this case, the document output tray 32 is disposed on the right side in FIG. 1 with respect to the document housing component 16.

The image reading unit 20 is disposed with a light source (not shown), an optical system (not shown) such as a mirror and an imaging lens, and an image reading element (not shown) that is structured with a CCD or the like.

A transparent member (called a platen glass A below) 38 such as a glass plate that transmits light that has been emitted from the light source of the image reading unit 20 is disposed in the conveyance path 34. This platen glass A38 forms a conveyance path surface of the conveyance path 34, and the position where the platen glass A38 is disposed is a reading position where the image reading unit 20 reads an image of the document that is conveyed on the conveyance path 34.

Thus, the document that is conveyed on the conveyance path 34 is irradiated with light from the light source of the image reading unit 20, reflected light that has been reflected by the document is guided through the optical system to the image reading element, and an image is read by the image reading element. At this time, the image reading unit 20 is in a state where it is positioned and fixed in a predetermined position below the platen glass A38.

A controller 43 is connected to the image reading unit 20, and the controller 43 converts the image that the image reading unit 20 has read into image signals and sends the converted image signals to an image recording unit 54.

Further, in the image reading mechanism 12 pertaining to the present exemplary embodiment, an inversion path 44 for inverting a document of which an image on one side has been read and again sending that document back to the reading position is connected to the conveyance path 34. A document of which an image on one side has been read is inverted by the ejecting rolls 39, is conveyed on the inversion path 44, and is again sent to the reading position.

Further, the image reading mechanism 12 is disposed, below the platen cover 13, with a transparent member 40 (called a platen glass B below) such as a glass plate that transmits light that has been emitted from the light source of the image reading unit 20. A document is placed on this platen glass B40 in a state where its reading surface is face down after the platen cover 13 has been opened. The document is disposed in a fixed position as a result of being placed in a predetermined position on the platen glass B40.

The image reading unit 20 moves below the platen glass B40 with respect to a document that has been placed on the platen glass B40 and reads an image of that document.

It will be noted that, in the present description, the platen glass A38 and the platen glass B40 are notated separately, but they may also be configured by a single transparent plate (glass or the like) that covers the range of the sizes of both platen glass plates.

Next, the image recording mechanism 14 will be described.

The image recording mechanism 14 is disposed with a recording medium housing component 50 in which a recording medium P such as paper is housed, a reading medium conveying component 52 that conveys the recording medium P that is housed in the recording medium housing component 50, an image recording unit 54 that is capable of recording an image on the recording medium P that is conveyed on the recording medium conveying component 52 on the basis of an image that the image reading unit 20 has read, and a recording medium output tray 56 into which the recording medium P that has been conveyed by the recording medium conveying component 52 is ejected.

The recording medium housing component 50 is disposed with a holder 58 for placing the recording medium P. The recording medium P is placed in this holder 58 and housed in the recording medium housing component 50. It will be noted that the recording medium housing component 50 may also be integrated with the document housing component 16.

The recording medium conveying component 52 is disposed with a feeding roll 60 that feeds the recording medium P that is housed in the recording medium housing component 50 from the recording medium housing component 50. A separating mechanism 62 that separates, one sheet at a time, the recording medium P that has been fed from the recording medium housing component 50 is disposed on the downstream side of the feeding roll 60. The separating mechanism 62 is disposed with a conveying roll 64, which imparts conveyance force to the recording medium P that has been fed by the feeding roll 60 from the front side of the recording medium P, and a separating pad 66, which imparts conveyance resistance to the recording medium P that has been fed by the feeding roll 60 from the back side of the recording medium P.

Thus, when plural recording media P are superimposed and fed from the recording medium housing component 50, the conveying roll 64 imparts conveyance force to the upper recording medium P (the first recording medium P), and conveyance resistance is imparted by the separating pad 66 to the lower recording media P (the second recording medium P on), whereby the recording media P are separated. In this manner, the superimposed recording media P are sorted and fed one sheet at a time by the feeding roll 60 and the separating pad 66.

A U-shaped conveyance path 68 for conveying the recording medium P that has been separated by the separating mechanism 62 to the recording medium output tray 56 is formed in the recording medium conveying component 52. Conveying rolls 74 that convey the recording medium P and ejecting rolls 70 that eject the recording medium P to the recording medium output tray 56 are disposed in this conveyance path 68.

The conveyance path 68 intersects the conveyance path 34 between the recording medium housing component 50 and the image recording unit 54. The conveyance path 34 intersects the conveyance path 68 between the document housing component 16 and the image reading unit 20.

Further, the conveyance path 68 is shared with the conveyance path 34 at the portion of the reading position where the platen glass A38 is disposed, and the recording medium P on which an image has been recorded by an inkjet recording head 53 is also conveyed to the reading position such that the image is readable by the image reading unit 20.

On the downstream side of this reading position, the conveyance path 68 and the conveyance path 34 branch and are respectively connected to the recording medium output tray 56 and the document output tray 32. At the branch between the conveyance path 68 and the conveyance path 34, a switching member 67 for switching the conveyance path to which the recording medium P and the document are guided is disposed. The distal end of the switching member 67 moves downward, closes the conveyance path 68 and opens the conveyance path 34, whereby the document or the recording medium P is guided to the ejecting rolls 39 and the document output tray 32. The distal end of the switching member 67 moves upward, closes the conveyance path 34 and opens conveyance path 68, whereby the document or the recording medium P is guided to the ejecting rolls 70 and the recording medium output tray 56.

The recording medium output tray 56 is disposed with a holder 72 in which the recording medium P that has been ejected by the ejecting rolls 70 is placed, and the recording medium P that has been ejected by the ejecting rolls 70 is placed in the holder 72 and housed in the recording medium output tray 56. Moreover, the image forming apparatus 10 may also be configured such that the document housing component 16, the recording medium housing component 50, the document output tray 32 and the recording medium output tray 56 are disposed in a tier-like manner in order to make it easy to handle housing of documents, replenishment of recording media, documents after ejection and recording media after ejection.

It will be noted that the recording medium output tray 56 may also be integrated with the document output tray 32.

Further, the recording medium output tray 56 is offset in the width direction of the recording medium P (direction orthogonal to the conveyance direction) with respect to the recording medium housing component 50, and the recording medium output tray 56 and the recording medium housing component 50 are disposed in a tier-like manner. It will be noted that when the image forming apparatus 10 is configured such that a person who handles the document from one side in the width direction of the document faces the apparatus (e.g., when an operating component for performing reading operation and the like is disposed on one side in the width direction of the document), the recording medium output tray 56 is offset with respect to the recording medium housing component 16 on that side.

Further, the recording medium output tray 56 may also be configured such that it is offset along the conveyance direction with respect to the recording medium housing component 50 and is placed in a tier-like manner. In this case, the recording medium output tray 56 is disposed on the right side in FIG. 1 with respect to the recording medium housing component 50.

The image recording unit 54 is disposed with an inkjet recording head 53 which, as one example of a liquid droplet ejecting head that ejects liquid droplets, ejects ink droplets from nozzles to record an image on the recording medium P. The inkjet recording head 53 ejects ink droplets onto the recording medium P that has been conveyed to an image recording position below the inkjet recording head 53 and records an image.

An ink tank 55 that supplies ink to the inkjet recording head 53 is disposed above the inkjet recording head 53.

A maintenance member 57 that performs maintenance of the inkjet recording head 53 is disposed below the inkjet recording head 53 facing an ejection surface of the inkjet recording head 53. The maintenance member 57 includes a cap that covers the ejection surface of the inkjet recording head 53, a cleaning member that cleans the ejection surface of the inkjet recording head 53, and a suction device for sucking the ink inside the nozzles.

Further, in the image recording mechanism 14, an inversion path 65 for inverting the recording medium P on which an image has been recorded on one side and again sending that recording medium P back to the image recording position is connected to the conveyance path 68. The recording medium P on which an image has been recorded on one side is conveyed as it is when the ejecting rolls 70 normally rotate, but by disposing a one-way gate just before the ejecting rolls 70, the ejecting rolls 70 are caused, during back side printing, to reversely rotate immediately before the completion of ejection, whereby the recording medium P on which an image has been recorded on one side is conveyed on the inversion path 65 and is again sent to the image recording position.

It will be noted that, in the image forming apparatus 10 pertaining to the present exemplary embodiment, the document housing component 16, the document output tray 32, the feeding roll 24, the separating mechanism 30, the recording medium housing component 50, the recording medium output tray 56, the feeding roll 60 and the separating mechanism 62 are disposed in the platen cover 13, and these are opened and closed integrally with the platen cover 13. The platen cover 13 rotates about a shaft component 15 and can be flipped up, so that by flipping up and opening the platen cover 13, the upper surface of the platen glass B40 is opened and documents such as a book can be placed on the platen glass B40.

Moreover, the platen cover 13 may also employ automatic opening and closing. For example, the platen cover 13 can be configured such that the platen cover 13 is lifted up and opened when an operator places his/her hand over a sensor or configured such that the platen cover 13 is opened automatically after the image reading unit 20 has read an image of a document.

Further, although the aforementioned opening and closing system is described as being a system where the platen cover 13 is flipped up by rotation, the system may also be one where the platen cover 13 moves by sliding.

It will be noted that whether each component of the image reading mechanism 12 and each component of the image recording mechanism 14 is to be disposed in the platen cover 13 is optional, and it suffices as long as the image forming apparatus 10 is configured such that the upper surface of the platen glass B40 is opened when the platen cover 13 is opened.

(Action of Present Exemplary Embodiment)

Next, the action of the preceding exemplary embodiment will be described.

In the image forming apparatus 10 pertaining to the present exemplary embodiment, when an operator wishes to read an image of a document, the operator either places the document on the platen glass B40 or houses the document in the document housing component 16.

The image reading unit 20 moves with respect to a document that has been placed on the platen glass B40 and reads an image of that document. The image reading unit 20 is fixed in a position relative to the platen glass A38 with respect to a document that has been housed in the document housing component 16 and reads an image of that document as a result of the document being moved by the document conveying component 18.

After an image of the document has been read the operator removes the document that has been placed on the platen glass B40 from the top of the platen glass B40 or removes the document that has been ejected into the document output tray 32 from the document output tray 32.

Moreover, when an operator wishes to copy the image of the document, the operator houses the recording medium P in the recording medium housing component 50. The image recording unit 54 records the image on the recording medium P on the basis of the image that the image reading unit 20 has read.

After the image has been recorded on the recording medium P, the operator removes the recording medium P that has been ejected into the recording medium output tray 56 from the recording medium output tray 56.

Here, in the present exemplary embodiment, the document housing component 16, the document output tray 32, the recording medium housing component 50 and the recording medium output tray 56 are consolidated on the side of the document that has been placed on the platen glass B40, that is, above the image reading unit 20, when seen from the image reading unit 20, and it becomes possible to perform, above the image reading unit 20, all of the work of placing the document on the platen glass B40, the work of housing the document in the document housing component 16, the work of removing the document from the document output tray 32, the work of housing the recording medium P in the recording medium housing component 50 and the work of removing the recording medium P from the recording medium output tray 56.

Thus, operability when handling the document and the recording medium P improves. Further, visibility when viewing the document and the recording medium P from above the image reading unit 20 improves. Moreover, the apparatus space on the lower side of the image reading unit 20 is made compact.

It will be noted that, in the present exemplary embodiment, the document of which an image has been read can be guided to the ejecting rolls 70 by the switching member 67. Thus, that document can be inverted by the ejecting rolls 70, conveyed on the inversion path 65 and sent to the image recording position so that the image that the image reading unit 20 has read can be recorded on the back side of the document. It will be noted that "back side of the document" refers to the surface on the opposite side of the surface on which is recorded the image that the image reading unit 20 has read.

Further, in the present exemplary embodiment, the recording medium P on which an image has been recorded by the inkjet recording head 53 is also conveyed to the reading position so that the image is capable of being read by the image reading unit 20, and the image that the inkjet recording head 53 has recorded can be read and evaluated by the controller 43. Moreover, this evaluation result can be fed back to image recording of the inkjet recording head 53 so that the image quality can be evaluated. For example, the controller 43 can evaluate whether or not there are defects in the image and detect clogging of the nozzles of the inkjet recording head 53, evaluate the image density and writing position (ejection position) between each color and perform adjustment of the image density and the writing position between each color, and evaluate and position positional shifting of the images that have been recorded on the front side and the back side of the recording medium P.

Further, in the image forming apparatus 10 pertaining to the present exemplary embodiment, the controller 43 may also be configured to control the feeding and ejection of the document and the recording medium P. For example, when a document is housed in the document housing component 16, the controller 43 can be configured to ensure that document is given priority over the recording medium P which is housed in the recording medium housing component 50 and is fed to thereby perform image reading of the document before image recording on the recording medium P. Further, the controller 43 may also be configured to switch between feeding of the document and feeding of the recording medium P one sheet or several sheets at a time.

Moreover, in order to make it easy to handle housing of documents, replenishment of recording media, documents after ejection and recording media after ejection, the image forming apparatus 10 pertaining to the present exemplary embodiment may also be configured such that the recording medium housing component 50 is offset in the width direction of the recording medium P with respect to the document housing component 16, the document output tray 32 is offset in the width direction of the recording medium P with respect to the recording medium housing component 50, and the recording medium output tray 56 is offset in the width direction of the recording medium P with respect to the document output tray 32, so that the document housing component 16, the recording medium housing component 50, the document output tray 32 and the recording medium output tray 56 are disposed in a tier-like manner. It will be noted that the direction in which these components are offset in this configuration may be a direction along the conveyance direction.

Further, a unit (casing) 21 that includes the platen glass B40 and the image reading unit 20 may also be configured such that it can be pulled out from the apparatus body 11. In this configuration, a document can be placed on the transparent member 40 and an image of that document can be read without having to open the platen cover 13.

Further, the unit (casing) 21 that includes the platen glass B40 and the image reading unit 20 may also be configured such that it is detachably attached to the apparatus body 11. This unit can be detached from the apparatus body 11 and used as an image forming apparatus that performs just recording of images.

Figure 9:
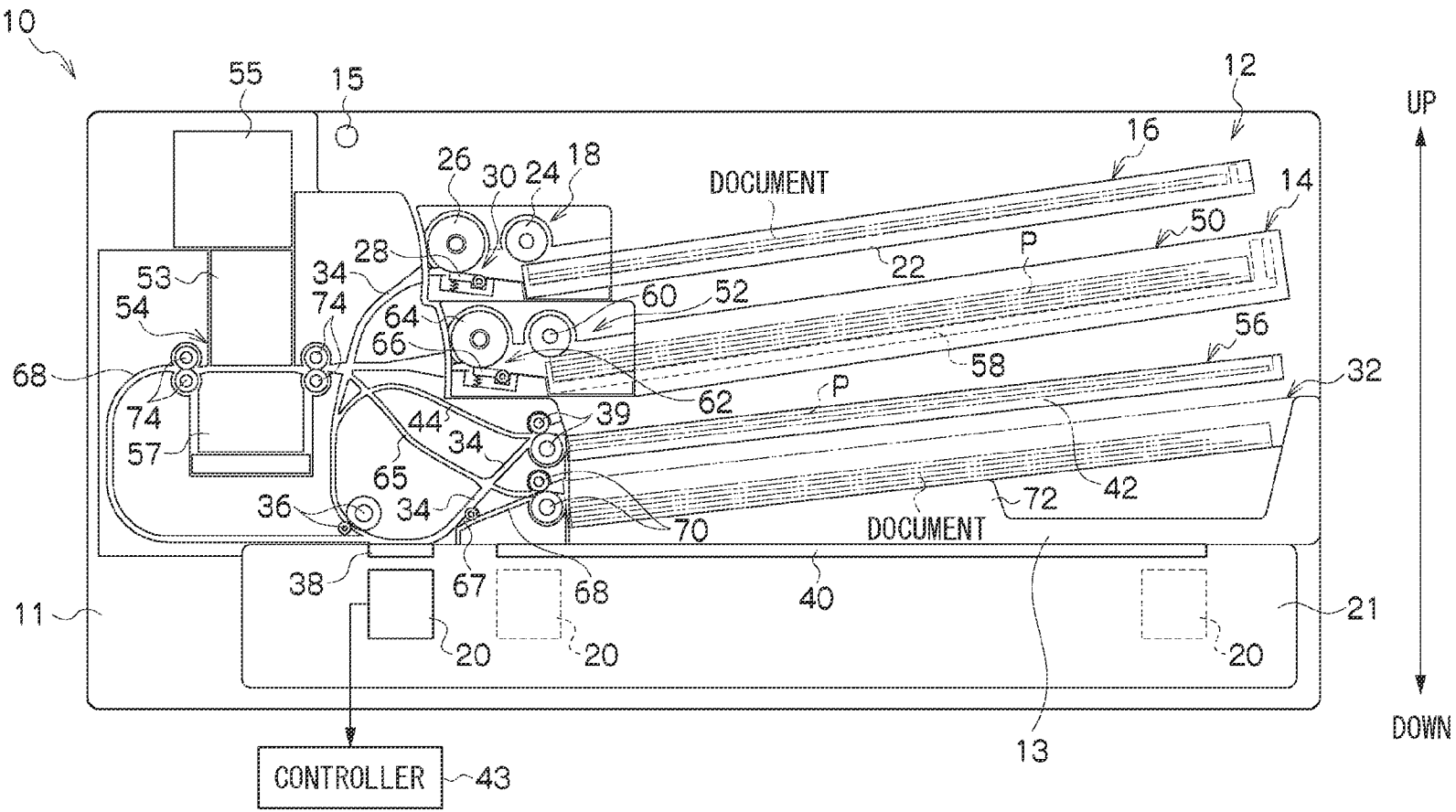
FIG. 9 is a general diagram showing a configuration where a recording medium housing component and a recording medium output tray are disposed between a document housing component and a document output tray in the image forming apparatus pertaining to the exemplary embodiment shown in FIG. 1.

Further, as shown in FIG. 9, the image forming apparatus 10 may also be configured such that the recording medium housing component 50 and the recording medium output tray 56 are disposed between the document housing component 16 and the document output tray 32. In this case, the document is conveyed from the holder 22 by the feeding roll 24 and the conveying roll 26, passes a position facing the transparent member 38 and the image reading unit 20, and is ejected into the document output tray 32 by the switching member 67. Similarly, the recording medium P is conveyed from the holder 58 by the feeding roll 60 and the conveying roll 64, an image is recorded on the recording medium P by the inkjet recording head 32, and the recording medium P thereafter passes a position facing the transparent member 38 and is ejected into the recording medium output tray 56 by the switching member 67.

(First Modification of Image Forming Apparatus Pertaining to Present Exemplary Embodiment)

Figure 2:
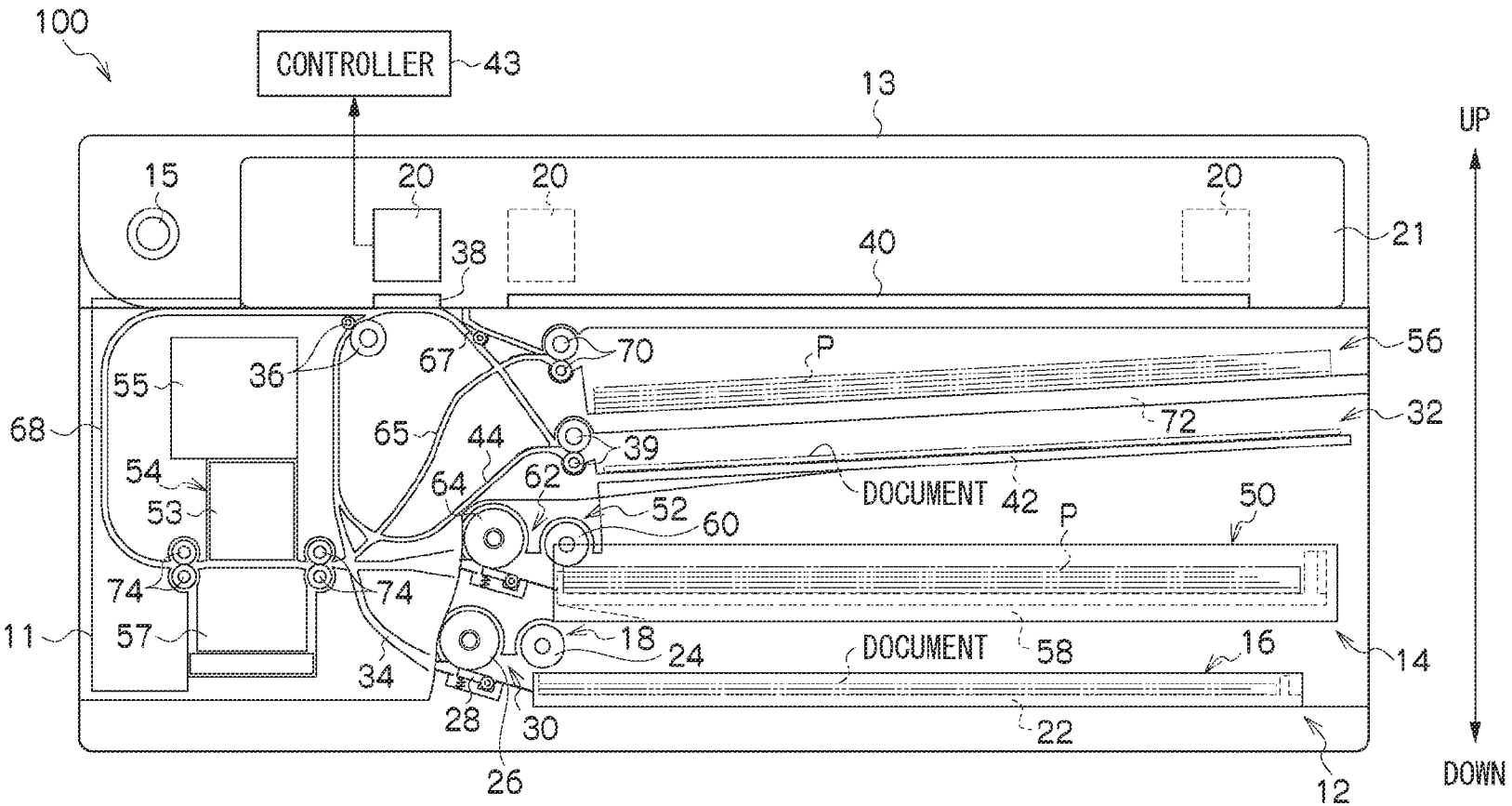
FIG. 2 is a general diagram showing the overall configuration of an image forming apparatus pertaining to a first modification.
Figure 3:
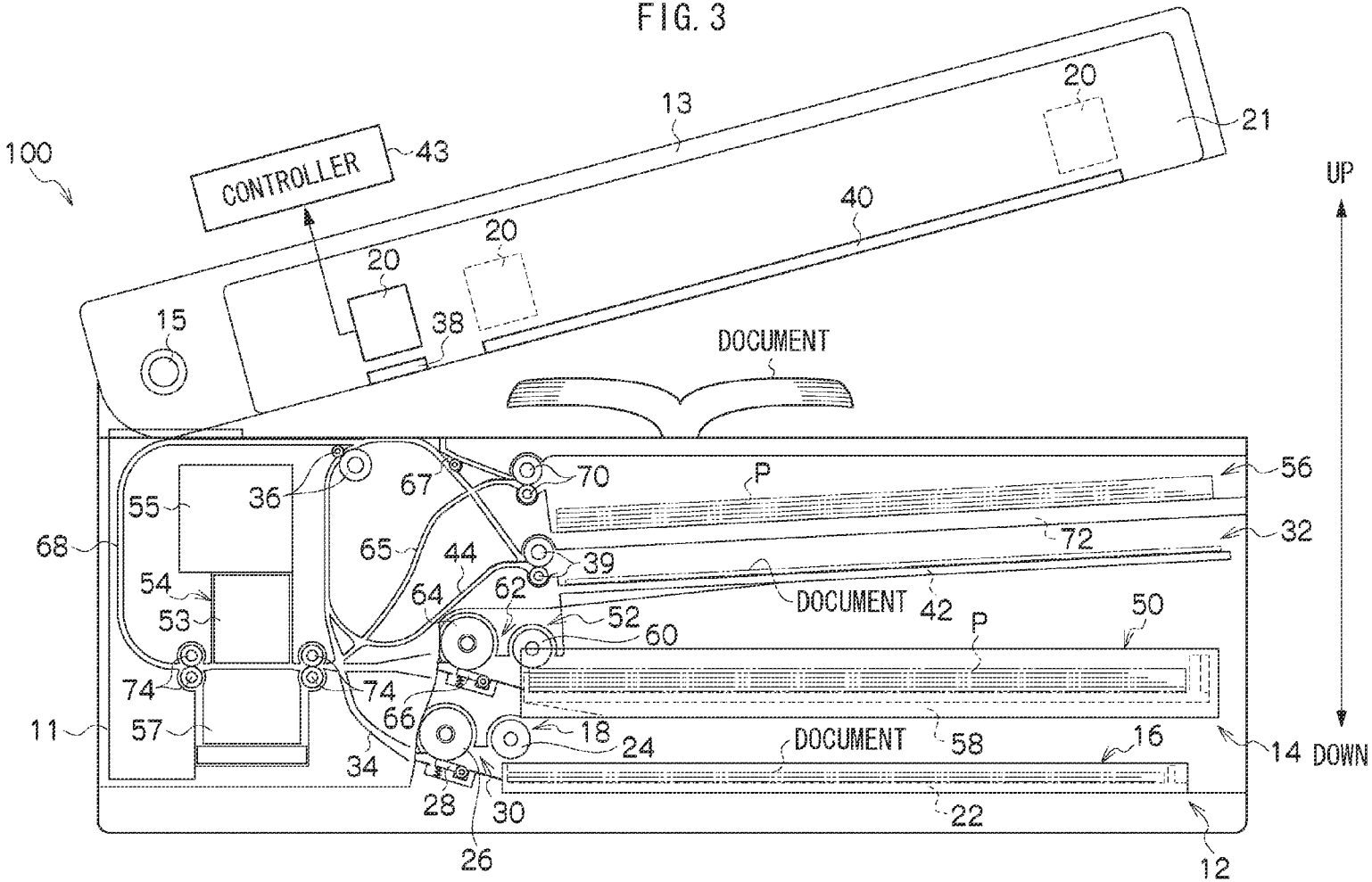
FIG. 3 is a general diagram showing an example of a state where a platen glass is opened in the image forming apparatus pertaining to the first modification.

Next, the overall configuration of an image forming apparatus 100 pertaining to a first modification will be described. FIG. 2 and FIG. 3 are general diagrams showing the overall configuration of the image forming apparatus 100 pertaining to the first modification.

The image forming apparatus 100 pertaining to the first modification is a modification where the disposed positions of each of the components in the above-described image forming apparatus 10 have been changed. It will be noted that the same reference numerals will be given to components that have the same functions as those of the above-described image forming apparatus 10 and that description of those components will be omitted.

The image forming apparatus 100 pertaining to the first modification is a system where, as shown in FIG. 2 and FIG. 3, the unit (casing) 21 that includes the image reading unit 20, the platen glass A38 and the platen glass B40 itself caused to move as an example of an open/close component that is disposed in the upper portion of the apparatus body 11 and is capable of being opened and closed with respect to the apparatus body 11.

As shown in FIG. 3, a document such as a book is placed with its reading surface face up below the transparent member 40, whereby an image of that document is read.

The document housing component 16, the document output tray 32, the recording medium housing component 50 and the recording medium output tray 56 are disposed in the apparatus body 11.

The document housing component 16, the document output tray 32, the recording medium housing component 50 and the recording medium output tray 56 are disposed in the order of the document housing component 16, the recording medium housing component 50, the document output tray 32 and the recording medium output tray 56 from below.

In the first modification, the document housing component 16, the document output tray 32, the recording medium housing component 50 and the recording medium output tray 56 are consolidated on the side of the document that has been placed below the platen glass B40, that is, below the image reading unit 20, when seen from the image reading unit 20, and all of the work of placing the document below the platen glass B40, the work of housing the document in the document housing component 16, the work of removing the document from the document output tray 32, the work of housing the recording medium P in the recording medium housing component 50 and the work of removing the recording medium P from the recording medium output tray 56 are performed below the image reading unit 20.

Thus, operability when handling the document and the recording medium P improves. Further, the apparatus space on the upper side of the image reading unit 20 is made compact. Moreover, when a document such as a book is placed below the platen glass B40, the work of reading and creating an image of that document by the image reading unit 20 can be performed while the platen cover 13 is left open.

(Second Modification of Image Forming Apparatus Pertaining to Present Exemplary Embodiment)

Figure 4:
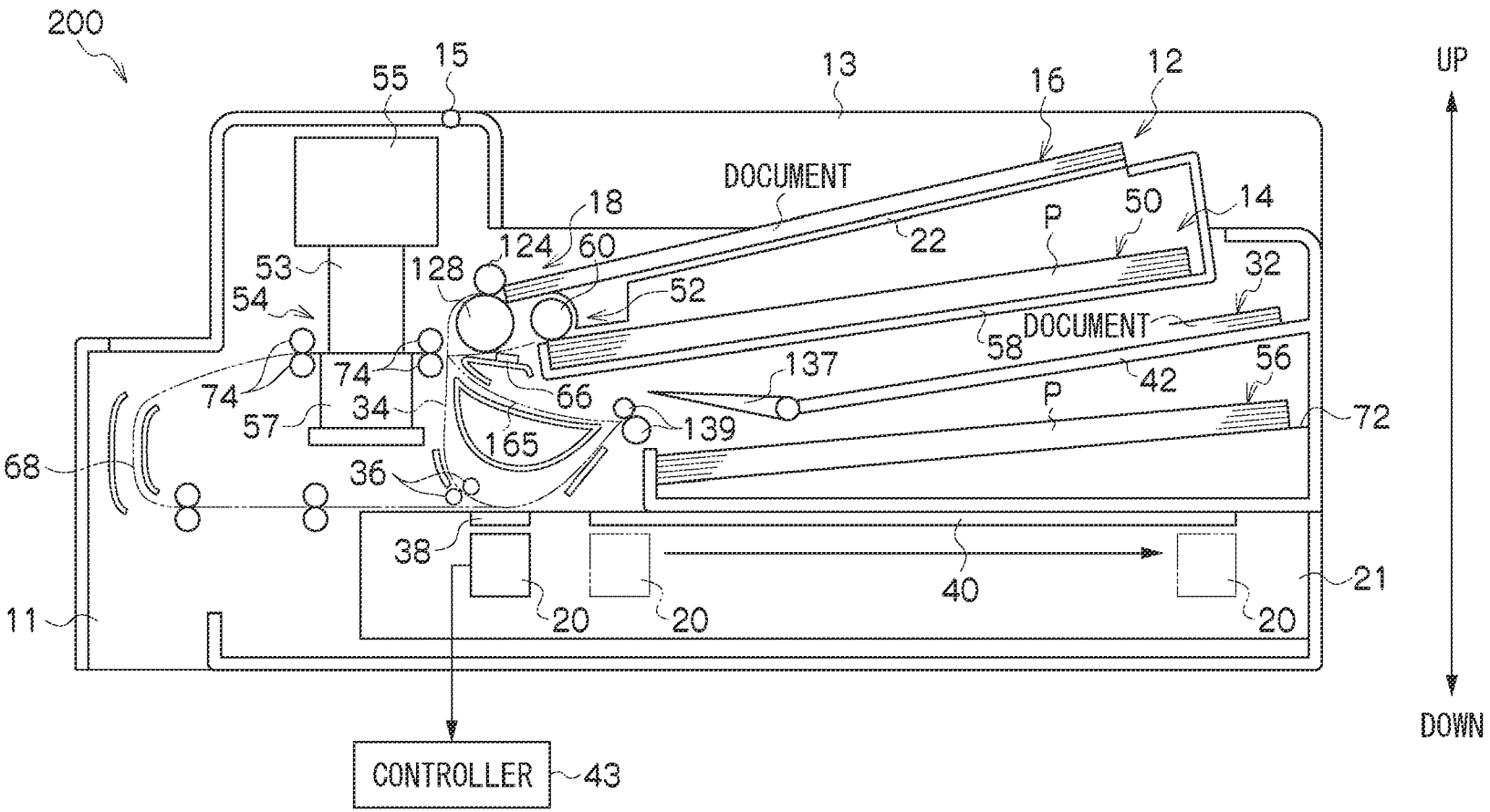
FIG. 4 is a general diagram showing the overall configuration of an image forming apparatus pertaining to a second modification.
Figure 5:
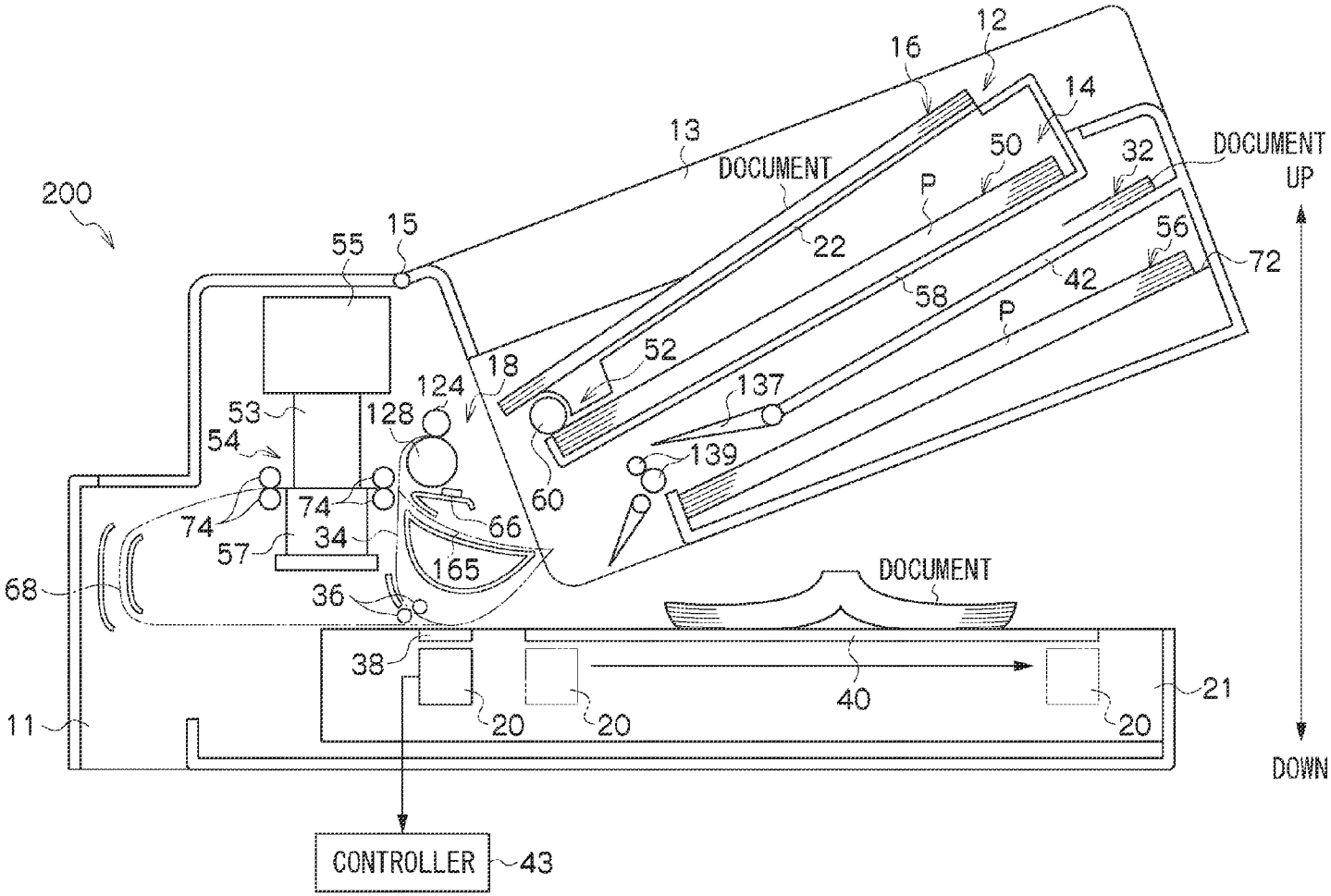
FIG. 5 is a general diagram showing an example of a state where a platen glass is opened in the image forming apparatus pertaining to the second modification.

Next, the overall configuration of an image forming apparatus 200 pertaining to a second modification will be described. FIG. 4 and FIG. 5 are general diagrams showing the overall configuration of the image forming apparatus 200 pertaining to the second modification. It will be noted that, in FIG. 4, the configurations of each of the components are simplified. Further, the same reference numerals will be given to components that have the same functions as those of the above-described image forming apparatus 10 and description of those components will be omitted.

The image forming apparatus 200 pertaining to the second modification has a configuration that uses the conveying mechanisms of the document conveying component and the recording medium conveying component in common and a configuration that uses the ejecting rolls of the document or the recording medium in common. A separating roll 128 is disposed in place of the separating pad 28 of the image forming apparatus 10. Further, a feeding roll 124 is disposed in place of the feeding roll 24 and the conveying roll 26 of the image forming apparatus 10. The feeding roll 124 feeds the document from the document housing component 16, cooperates with the separating roll 126 to sort (separate) superimposed documents, and conveys the documents one sheet at a time.

The documents or recording media are separately housed in a housing component that is integrally configured. In the drawings, when the separating roll 128 rotates in the counterclockwise direction, the document is fed, and when the separating roll 128 rotates in the clockwise direction, the recording medium fed.

Further, the above-described configuration is an example that uses the conveying mechanisms of the document conveying component and the recording medium conveying component in common, so, for example, the conveying mechanism of the aforementioned recording medium conveying component may be used, a document may be placed on the recording medium in the recording medium housing component, and the conveying mechanism may be used in common. However, in this case, it becomes necessary to dispose a device that detects whether or not the medium that is conveyed is a document or a recording medium (e.g., a configuration that senses, by a photosensor or the like, whether or not there is a document between the documents and the recording media) and to switch the conveyance destination to the image reading unit when there is a document on the basis of the sensing result and switch the conveyance destination to the image recording unit when there is no document.

In the image forming apparatus 200 pertaining to the second modification, the portion of the reading position where the transparent member 38 is disposed and the conveyance path on the downstream side (from the reading position to the document output tray 32 and the recording medium output tray 56) of that reading position are shared in common, and the conveyance path 34 and the conveyance path 68 are formed by one conveyance path. Further, the ejecting roll 39 and the ejecting roll 70 are shared, so the image forming apparatus 200 pertaining to the second modification is disposed with one pair of ejecting rolls 139.

A switching member 137 for switching the ejecting components to which the recording medium P and the document are guided is disposed downstream of the ejecting rolls 139. The distal end of the switching member 137 moves downward, closes the recording medium output tray 56 and opens the document output tray 32, whereby the document or the recording medium P is guided to the document output tray 32. The distal end of the switching member 137 moves upward, closes the document output tray 32 and opens the recording medium output tray 56, whereby the document or the recording medium P is guided to the recording medium output tray 56.

Further, the inversion path 44 and the inversion path 65 are also shared, so one inversion path 165 is disposed. The document or the recording medium P that has been inverted by the ejecting rolls 139 is sent to the conveyance path 68.

In the image forming apparatus 200 pertaining to the second modification, as shown in FIG. 5, the document housing component 16, the document output tray 32, the feeding roll 124, the separating roll 128, the recording medium housing component 50, the recording medium output tray 56, the feeding roll 60, the ejecting rolls 139 and the switching member 137 are disposed in the platen cover 13, and these are opened and closed integrally with the platen cover 13.

By employing the above configuration, it becomes possible to further make the apparatus compact and lower costs because the number of parts in the apparatus overall is reduced.

Figure 6:
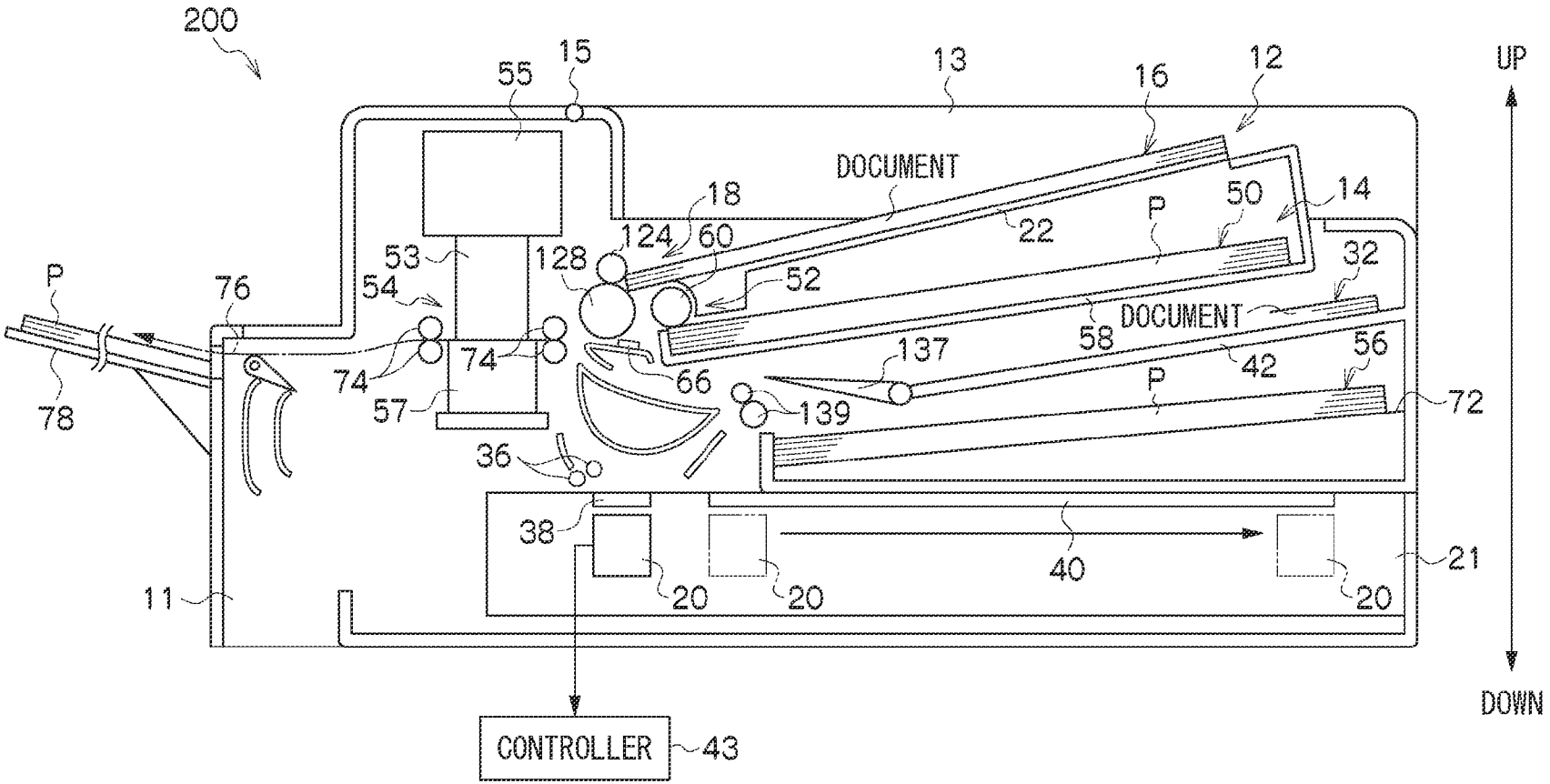
FIG. 6 is a general diagram showing a configuration where the image forming apparatus pertaining to the second modification is disposed with a conveyance path that conveys, in a transverse direction, a recording medium on which an image has been recorded.

Further, as shown in FIG. 6, the image forming apparatus 200 pertaining to the second modification may also be configured such that it is disposed with a conveyance path 76 that conveys, in a transverse direction, the recording medium P on which an image has been recorded by the inkjet recording head 53 of the image recording unit 54. In the configuration shown in FIG. 6, a recording medium output tray 78 into which the recording medium P that has been conveyed along the conveyance path 76 is ejected is disposed in a side portion of the apparatus body 11 of the image forming apparatus 200.

In this configuration, the recording medium P on which an image has been recorded by the inkjet recording head 53 maintains a planar state without curving and is conveyed along the conveyance path 76 and ejected into the recording medium output tray 78. It will be noted that, in this configuration, the recording medium P is conveyed from the right side to the left side in FIG. 6, but the image forming apparatus 200 may also be configured such that the recording medium P is housed in the recording medium output tray 78, and the housed recording medium P is conveyed from the left side to the right side in FIG. 6 and is ejected into the recording medium housing component 50.

Figure 7:
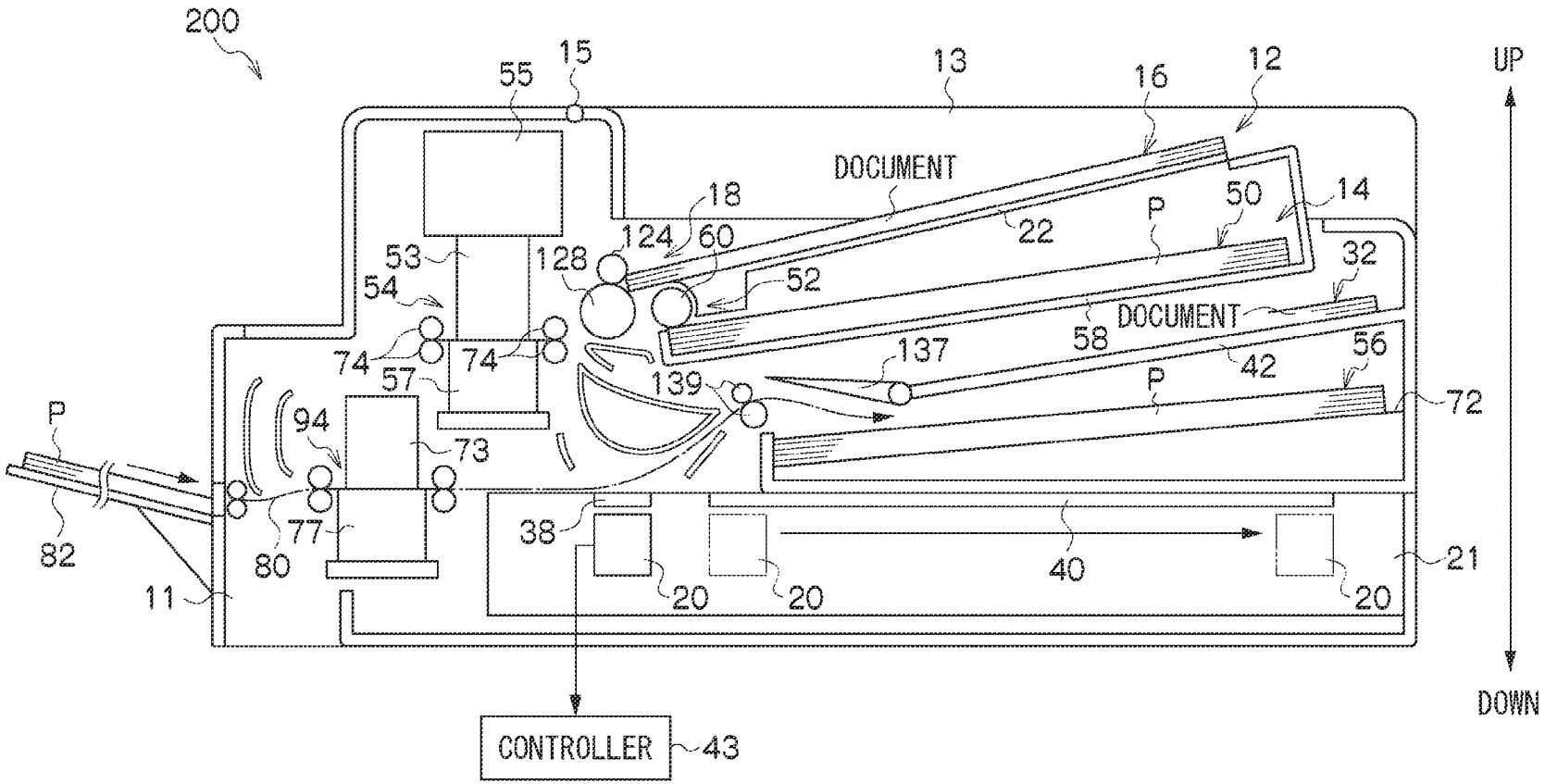
FIG. 7 is a general diagram showing a configuration where a second image recording unit has been added to the image forming apparatus pertaining to the second modification.

Further, as shown in FIG. 7, the image forming apparatus 200 may also be configured such that it is disposed with an image recording unit 94 in addition to the image recording unit 54. The image recording unit 94 is, similar to the image recording unit 54, disposed with an inkjet recording head 73 and a maintenance member 77.

In this configuration, the recording medium P on whose front side an image has been recorded by the inkjet recording head 53 is inverted by the conveyance path 68, an image is recorded on the back side of the recording medium P by the inkjet recording head 73, and the recording medium P is ejected into the recording medium output tray 56.

It will be noted that the image recording unit 94 is not only for recording an image on the back side of the recording medium P on which an image has been recorded on one side but may also be used for recording an image on one side of the recording medium P as in the following configuration. In this case, images can be recorded on the recording medium P at the same time by the image recording unit 54 and the image recording unit 94.

In the configuration where the image forming apparatus 200 is disposed with the image recording unit 94, as shown in FIG. 7, the image forming apparatus 200 may also be configured such that it is disposed with a conveyance path 80 for conveying the recording medium P in the transverse direction to the inkjet recording head 73. In this configuration, a recording medium housing component 82 in which the recording medium P that is sent to the conveyance path 80 is housed is disposed in a side portion of the apparatus body 11 of the image forming apparatus 200. In this configuration, the recording medium P that is housed in the recording medium housing component 82 maintains a planar state without curving, is conveyed along the conveyance path 80, an image is recorded by the inkjet recording head 73, and the recording medium P is ejected into the recording medium output tray 56.

It will be noted that, in this configuration, the recording medium P is conveyed from the left side to the right side in FIG. 7, but the image forming apparatus 200 may also be configured such that the recording medium P is housed in the recording medium output tray 56, and the housed recording medium P is conveyed from the right side to the left side in FIG. 7 and is ejected into the recording medium housing component 82.

Figure 8:
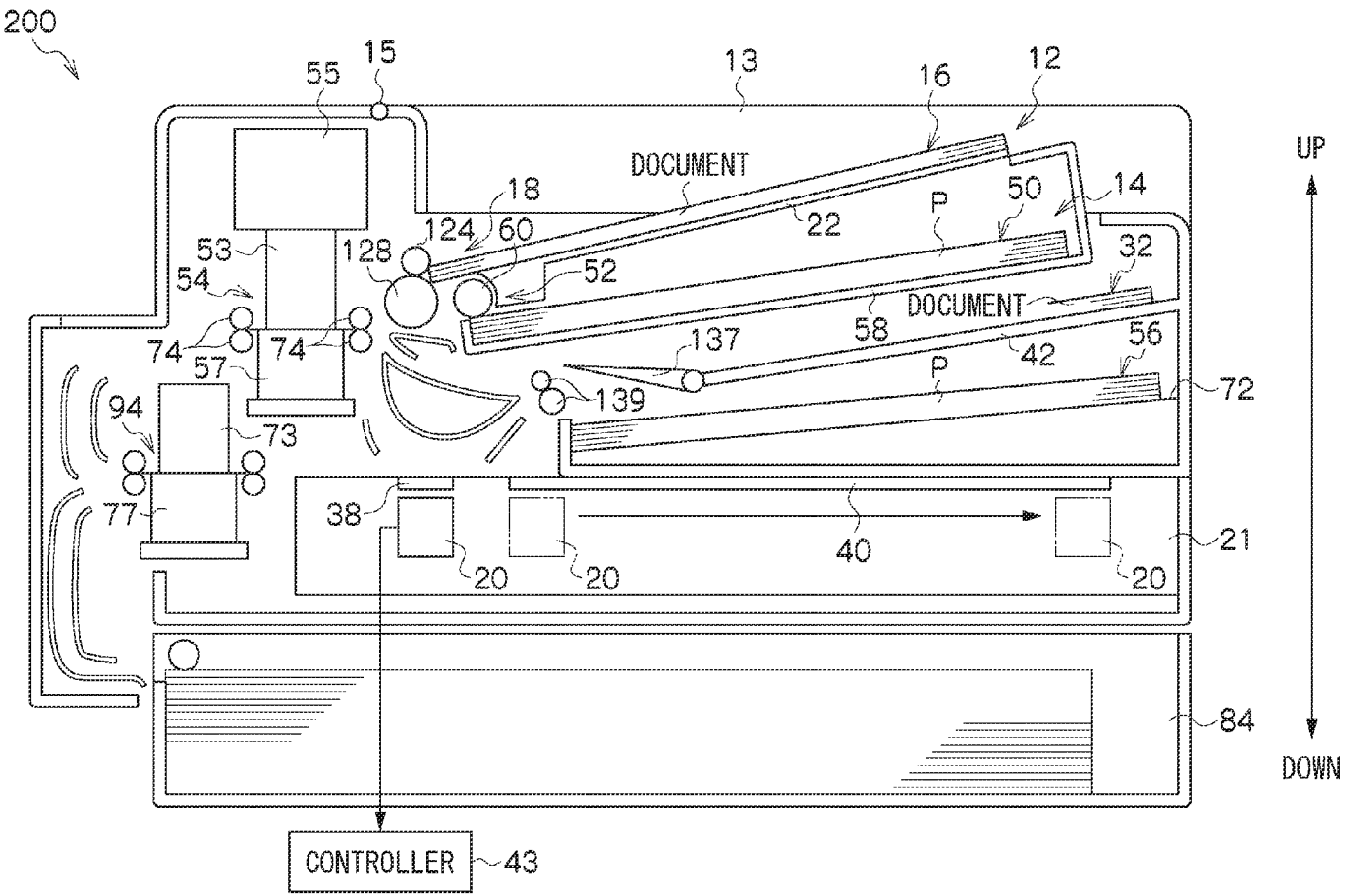
FIG. 8 is a general diagram showing a configuration where a recording medium housing component is attached to a lower portion of an apparatus body of the image forming apparatus pertaining to the second modification.

Further, as shown in FIG. 8, the image forming apparatus 200 may also be configured such that a recording medium housing component 84 is attached to the lower portion of the apparatus body 11. The recording medium housing component 84 is detachably attached to the lower portion of the apparatus body 11 as an option. In the configuration shown in FIG. 8, the image recording unit 94 is disposed, the recording medium P that is housed in the recording medium housing component 84 is fed from the recording medium hosing component 84, an image is recorded by the inkjet recording head 73 of the image recording unit 94, and the recording medium P is ejected into the recording medium output tray 56. In a configuration where the image forming apparatus 200 does not include the image recording unit 94 but is disposed with just the image recording unit 54, a conveyance path that conveys the recording medium P to the image recording unit 54 is formed.

It will be noted that the present invention is not limited to the preceding exemplary embodiment and that various modifications, changes and improvements are possible.

For example, the configuration shown in FIG. 6 that includes the conveyance path 80 and the recording medium output tray 78, the configuration shown in FIG. 7 that adds the image recording unit 94 and the configuration shown in FIG. 8 that includes the recording medium housing component 84 are applicable not only to the image forming apparatus 200 pertaining to the second modification but also to the image forming apparatus 10 pertaining to the present exemplary embodiment shown in FIG. 1 and the image forming apparatus 100 pertaining to the first modification shown in FIG. 2.

In the description of the present exemplary embodiment, there is applied an image forming system that uses an inkjet recording head as the image recording unit, but the image recording unit is not limited to this and there may also be used an image recording unit or the like that uses an electrophotographic system, for example.

Further, when the document loading tray (document housing component), the document output tray, the recording medium loading tray (recording medium housing component) and the recording medium output tray are arranged in a vertical direction, the document loading tray, the document output tray, the recording medium loading tray and the recording medium output tray may be disposed so as to be at least partially superimposed one another.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a document loading tray that loads a document;

a document transport path that transports the document;

an image reading unit that is disposed in the document transport path and reads an image of the document;

a document output tray into which the document that has been transported on the document transport path is ejected;

a recording medium loading tray into which a recording medium is loaded;

a recording medium transport path on which the recording medium is transported;

an image recording unit that is disposed in the recording medium transport path and records an image on the recording medium on the basis of image signals of the image that the image reading unit has read or input signals from the outside; and a recording medium output tray into which the recording medium that has been transported on the recording medium transport path is output, the recording medium loading tray being disposed between the document loading tray and the document output tray in a vertical direction.

2. The image forming apparatus of claim 1, wherein the document transport path intersects the recording medium transport path between a document transport starting position where transport of the document is started and the image reading unit.

3. The image forming apparatus of claim 1, wherein the recording medium transport path intersects the document transport path between a recording medium transport starting position where transport of the recording medium is started and the image recording unit.

4. The image forming apparatus of claim 1, wherein the image reading unit is disposed below the recording medium transport path.

5. The image forming apparatus of claim 1, wherein the image reading unit is disposed above the recording medium transport path.

6. The image forming apparatus of claim 1, wherein the document loading tray, the document output tray, the recording medium loading tray and the recording medium output tray are arranged in a vertical direction in the order of the document loading tray, the recording medium loading tray, the document output tray and the recording medium output tray.

7. The image forming apparatus of claim 1, wherein the document loading tray, the document output tray, the recording medium loading tray and the recording medium output tray are arranged in a vertical direction in the order of the document loading tray, the recording medium loading tray, the recording medium output tray and the document output tray.

8. The image forming apparatus of claim 1, wherein the document loading tray, the document output tray, the recording medium loading tray and the recording medium output tray are arranged in a vertical direction in the order of the recording medium output tray, the document output tray, the recording medium loading tray and the document loading tray.

9. The image forming apparatus of claim 1, wherein the document loading tray, the document output tray, the recording medium loading tray and the recording medium output tray are arranged in a vertical direction in the order of the document output tray, the recording medium output tray, the recording medium loading tray and the document loading tray.

10. The image forming apparatus of claim 1, wherein the image reading unit is disposed so as to be movable between a position where the image reading unit reads a document in the document transport path and a position where the image reading unit reads a document that has been placed in a fixed position.

11. An image forming apparatus comprising:

a document transport path that transports a document;

an image reading unit that is capable of moving with respect to a document that has been placed in a fixed position and reading an image of that document and that reads an image of a document that is transported by the document transport path;

a document output tray that, with respect to a reading surface of the document that is placed in a fixed position, is disposed on a side that is opposite to the image reading unit and into which a document that has been transported by the document transport path is ejected;

a recording medium transport path that transports a recording medium;

an image recording unit that records an image on a recording medium that is transported by the recording medium transport path on the basis of image signals of an image that the image reading unit has read or input signals from the outside; and a recording medium output tray that, with respect to the reading surface of the document that is placed in the fixed position, is disposed on the side that is opposite to the image reading unit and into which a recording medium that the recording medium transport path has transported is output.

12. The image forming apparatus of claim 11, wherein the document output tray and the recording medium output tray are disposed above the reading surface of the document.

13. The image forming apparatus of claim 11, wherein the document output tray and the recording medium output tray are disposed below the reading surface of the document.

14. The image forming apparatus of claim 11, further comprising a document loading tray that, with respect to the image reading unit in a state where the image reading unit is reading a document that has been placed in the fixed position, is disposed on a side where that document is positioned and in which a document that the document transport path transports is housed and a recording medium loading tray that, with respect to the image reading unit in a state where the image reading unit is reading a document that has been placed in the fixed position, is disposed on a side where that document is positioned and in which a recording medium that the recording medium transport path transports is housed.

15. The image forming apparatus of claim 11 wherein the recording medium transport path transports a recording medium on which an image has been recorded by the image recording unit to the image reading unit, and the image reading unit is capable of reading an image that has been recorded by the image recording unit.

16. The image forming apparatus of claim 11, wherein the document transport path inverts a document of which an image has been read by the image reading unit and transports that document to the image recording unit, and the image recording unit is capable of recording an image on the back side of the document of which an image has been read by the image reading unit.

* * * * *